US005190399A

United States Patent [19]

Chappat et al.

[11] Patent Number: 5,190,399

[45] Date of Patent: Mar. 2, 1993

[54] ROAD VEHICLE FOR THE SPREADING OF MATERIALS FOR REPAIR OF THE HIGHWAY, WITH INTEGRATED COMPACTOR

[75] Inventors: Michel Chappat, Maurepas; Jean-Pierre Reymonet, Le Chesnay, both of France

[73] Assignee: Colas S.A., Boulogne-Billancourt Cedex, France

[21] Appl. No.: 755,769

[22] Filed: Sep. 6, 1991

[30] Foreign Application Priority Data

Oct. 30, 1990 [FR] France ..... 90 13475

[51] Int. Cl.[5] ..... E01C 23/12

[52] U.S. Cl. ..... 404/102; 404/108

[58] Field of Search ..... 404/102, 108, 110, 111

[56] References Cited

U.S. PATENT DOCUMENTS

| | | | |
|---|---|---|---|
| 1,931,942 | 10/1933 | Tranaas | 404/108 X |
| 2,962,947 | 12/1960 | MacDonald | 404/108 |
| 3,398,662 | 8/1968 | Takata et al. | 404/108 X |
| 3,508,475 | 4/1970 | Smith | 404/102 |
| 4,231,678 | 11/1980 | Carternock | 404/103 |
| 4,300,853 | 11/1981 | Jones | 404/108 X |

FOREIGN PATENT DOCUMENTS

| | | |
|---|---|---|
| 0292337 | 11/1988 | European Pat. Off. . |
| 0370135 | 5/1990 | European Pat. Off. . |
| 2833311 | 2/1979 | Fed. Rep. of Germany . |
| 3904117 | 8/1990 | Fed. Rep. of Germany . |
| 823733 | 10/1936 | France . |
| 2199874 | 7/1988 | United Kingdom . |

*Primary Examiner*—William P. Neuder

*Attorney, Agent, or Firm*—Sandler Greenblum & Bernstein

[57] ABSTRACT

Vehicle including, mounted on a chassis, a device for receiving material to be spread, a device for transferring the material towards a spreading component, a tank for binding product, a distribution bar, and a motorization assembly. The chassis includes at a rear portion, after the component for spreading the material, and mounted on rollers or balls that are rotatable independent of rolling elements mounted on a front portion, at least one of the motorization assembly, the tank and a control and transmission mechanism providing weight to the rear portion to permit the rear portion to act as a compactor.

22 Claims, 3 Drawing Sheets

ROAD VEHICLE FOR THE SPREADING OF MATERIALS FOR REPAIR OF THE HIGHWAY, WITH INTEGRATED COMPACTOR

BACKGROUND OF THE INVENTION

1. Field of the Invention

The present invention relates to a road vehicle for the spreading of materials for repair of the highway, such as asphalt coated materials or chippings comprising a carrier chassis mounted on rolling elements and on which are disposed: a device for receiving the material, a device for transferring the material towards a component for spreading the material over the highway, a tank for product for binding the material onto the highway, a spreading bar for distributing this product, which is disposed in front of the spreading component, a motorization assembly, and hydraulic control and transmission means connecting the motorization assembly to the components of the vehicle and to a unit for driving this vehicle.

2. Description of the Prior Art

Such vehicles of type already known are advantageously arranged in order to form a single road train whose constituent elements are adapted, non-interchangeably, according to whether it concerns depositing on the highway an asphalt coated material or chippings amalgamated by a binder.

Prior to the construction and to the use of this type of road vehicle, it was traditional to spread over the highway a layer of a binding product or a layer of binder, such as an asphalt emulsion, prior to the deposition of the asphalt coated material or the chippings, by means of a machine independent of that effecting this deposition and comprising a tank truck and a spreading bar for spreading said product. Such a technique multiplied the number of vehicles to be employed and, moreover, a coordination between them was necessary.

In fact, in the case of a gritting of the highway, after the passage of the tank truck, equipped with the spreading bar and the asphalt layer, there followed that of a dump truck, equipped with a gritter device, moving immediately behind the tank truck in order to spread the chippings over said asphalt layer forming a binder.

In the case of a highway repair by depositing a layer of asphalt coated materials, it was known to have the tank truck, fitted with a spreading bar for spreading a binding layer, followed by a conventional finisher, supplied by trucks, and whose application table spread out said coated materials over the highway in a layer of predetermined thickness.

In all cases, a compacting of the material deposited on the highway is effected by the passage of a third vehicle formed by a compactor roller.

The aforementioned road vehicles, forming a single train, make it possible to solve a good number of these difficulties by combining in the one vehicle a binding product tank and its distribution bar at the same time as a device for receiving the material, such as asphalt coated materials or chippings conveyed by a transfer device towards a component for spreading over the highway, which component is disposed after the binding-product distribution bar.

Such an arrangement makes it possible to prevent the drying out of the binding layer in the ambient air, before application of the repair material, arising when this application happens after some length of time, and makes it possible generally to limit the degradation of the binding layer.

Furthermore, this arrangement makes it possible to combine two vehicles in a single one. But nevertheless, it does not remove the necessity of using independently a compacting roller having to pass behind the vehicle within a time not permitting the drying out of the deposited material, in order to obtain a better compacting of the latter.

The object of the present invention is to remedy this drawback and relates for this purpose to a road vehicle.

SUMMARY OF THE INVENTION

The present invention relates to a road vehicle for the spreading of materials for repair of the highway, such as asphalt coated materials or chippings, comprising a carrier chassis mounted on rolling elements and on which are disposed:

a device for receiving the material a device for transferring the material towards a component for spreading the material over the highway a tank for product for binding the material onto the highway a binding-product distribution bar disposed in front of the spreading component a motorization assembly hydraulic control and transmission means connecting the motorization assembly to the components of the vehicle and to a unit for driving the vehicle.

According to the invention, the road vehicle is characterized in that the chassis comprises a portion situated at the rear of the component for spreading the material and mounted on rollers or balls, independently of the rolling elements connected to the motorization assembly and mounted on a front portion of the chassis, and on which rear portion is disposed at least one of the components which make up the motorization assembly, the tank and the control and transmission means, in such a manner that their own weight, being exerted on this rear chassis portion, makes the latter suitable to form a compactor of the materials spread over the highway.

Thus there is obtained an independent motorized vehicle, comprising the three aforementioned functions which happen in succession with a perfect regularity. This has the effect of improving the quality of the road surface. Furthermore, such a vehicle is fed during working by virtue of an appropriate disposition of the device for receiving the material, thus preventing any downtime due to loading.

It should also be noted that such a vehicle is driven by a single operator and has a single motorization assembly. This represents an increase in the productivity and a relative reduction in the cost price of the vehicle when the latter also fulfills an additional compacting function according to the invention.

The present invention also relates to the characteristics hereinbelow, considered solely or according to all their technically possible combinations:

According to another characteristic of the invention, the rear and front portions are distinct in order to form two chassis connected to each other by articulated linking means.

Thus, the vehicle comprises a front chassis and a rear chassis. The rear chassis, loaded in weight in order to form a compactor, is thus trailed by the front chassis.

According to a nonlimiting embodiment, the rear chassis supports the motorization assembly and the latter is connected to the rolling elements of the front chassis by means of a cardan transmission.

Of course, the weight on the rear chassis may also be obtained by the presence on the latter of the tank or of the means for control or for transmission, or all of these at the same time.

According to an alternative embodiment, the motorization assembly is connected to the rolling elements of the front chassis by means of a hydraulic transmission.

According to another characteristic of the invention, the motorization assembly is essentially formed by a thermal engine and provides, by means of the hydraulic control and transmission means which are also supported by the rear chassis, the travel of the vehicle according to a pre-adjusted working speed.

According to another characteristic of the invention, the device for receiving the material is disposed on the front chassis of the vehicle.

This offers the advantage of being able to supply the reception device during working and without risk of the passage of the supply truck over the treated zones of the highway.

According to a characteristic of the invention, the component for spreading the material over the highway is disposed at the rear portion of the front chassis, immediately in front of a first roller or ball of the compactor-forming rear chassis.

According to another characteristic of the invention, the transfer device connects the device for receiving the material to the component for spreading the material.

According to another characteristic of the invention, the binding-product distribution bar is disposed immediately before the component for spreading the material over the highway.

According to another embodiment particularly adapted for road surfaces formed by asphalt coated materials, the spreading component is a helical screw onto which the asphalt coated materials are brought by means of the transfer device.

Moreover, according to a certain number of advantageous characteristics belonging to this embodiment:

in the direction of travel, the screw for spreading the asphalt coated materials is immediately preceded by the distribution bar fed with asphalt emulsion from the tank;

a table for applying the asphalt coated materials is suspended at the rear portion of the front chassis, between the spreading screw and the first roller of the compactor-forming rear chassis;

the application table is suspended on the front chassis, according to a height adjustable by hydraulic jacks;

the helical screw forming the component for spreading the asphalt coated materials is laterally telescopic in such a manner that it can be adapted to the width of the highway;

the application table is laterally telescopic in such a manner that it can be adapted to the width of the highway.

According to another characteristic of the invention, the rear chassis comprises three rollers or balls, the first two of which are laterally telescopic in order to be adapted to the width of the highway, and the third is disposed transversely to the vehicle and such that it is fixed in translational movement.

According to another embodiment, particularly adapted for the laying of road surfaces formed by chippings amalgamated by a binder, the spreading component is formed by at least one hopper equipped with gritters and loaded at its upper portion, by its larger opening, with chippings brought by means of transfer device, its narrower lower portion being situated close to the highway.

Moreover, according to a certain number of advantageous characteristics belonging to this embodiment:

in the direction of travel, the hopper equipped with gritters is immediately preceded by the distribution applicator fed with binder from the tank;

the compacting rollers of the second chassis are formed by pneumatic-tired wheels;

the rear chassis is equipped, at its rear portion, with a device for sweeping and sucking up the excess chippings, completing the travel of the vehicle.

BRIEF DESCRIPTION OF THE DRAWINGS

The invention will be further illustrated, without being in any way limited, by the description which follows made with reference to the attached drawings in which.

DESCRIPTION OF PREFERRED EMBODIMENTS

Figure 1:
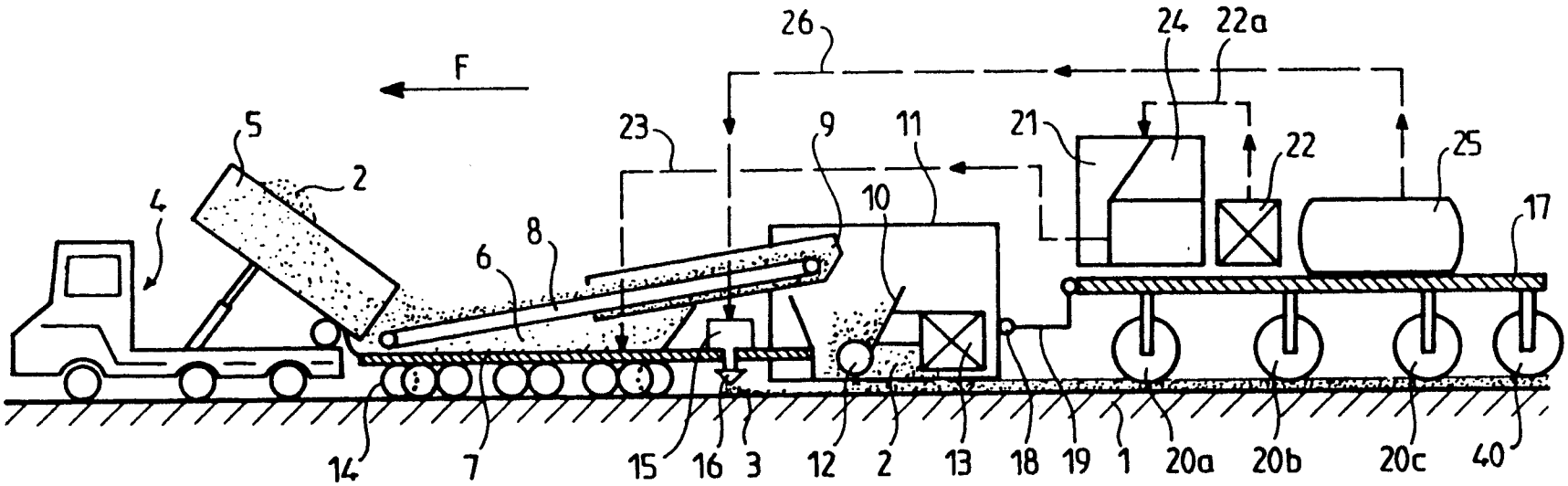
FIG. 1 is a longitudinal diagrammatic view of a vehicle according to the invention during working.
Figure 2:
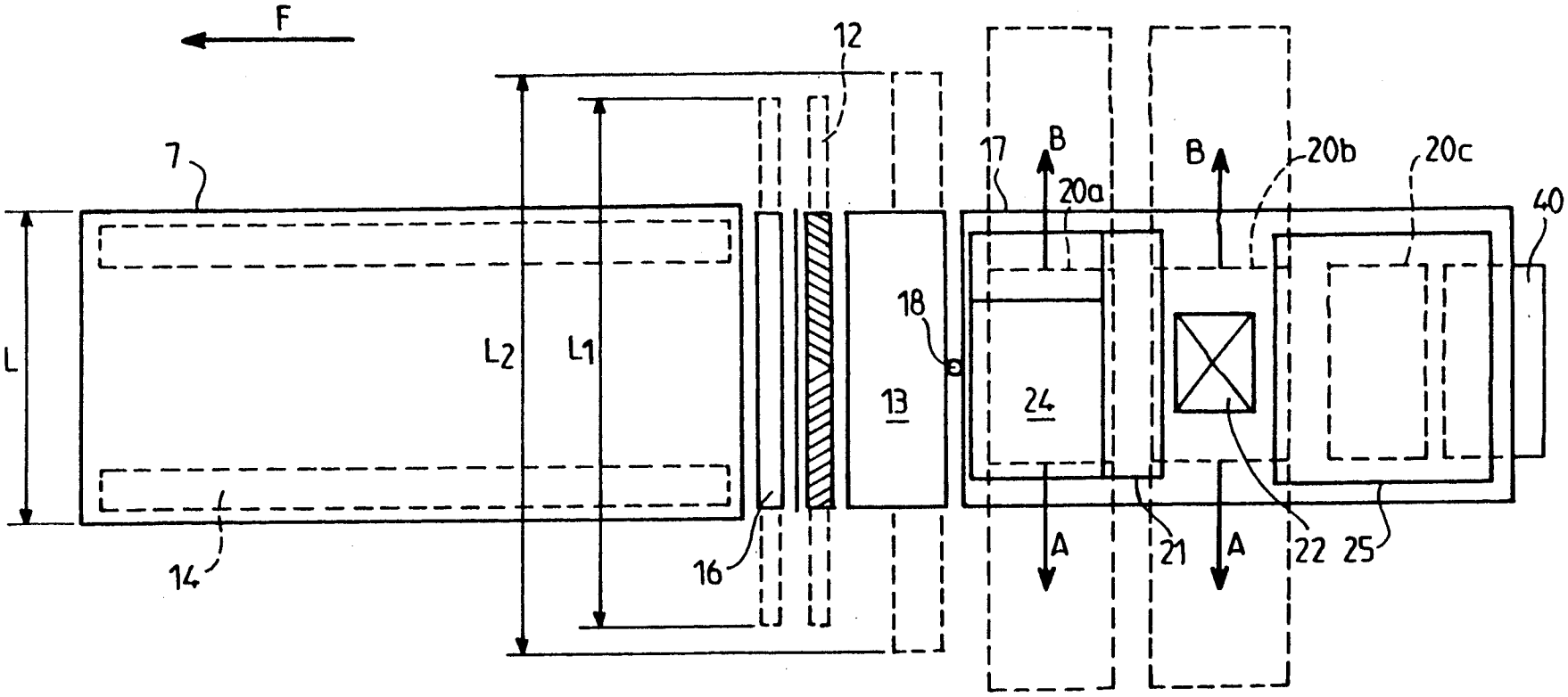
FIG. 2 is a diagrammatic view from above of the vehicle according to FIG. 1.

The road vehicle is represented in FIG. 1 during its implementing on a highway 1 on which is disposed a layer of asphalt coated materials 2 after a binding layer 3 formed by an asphalt emulsion.

The road vehicle, moving in the direction of the arrow F, is fed by means of a truck 4 dumping the contents of a dumper 5, which contents are formed in this case by coated materials, into a hopper 6 forming a device for receiving the coated materials on the vehicle. The reception hopper 6 is disposed on a front chassis 7 of the vehicle carried and driven caterpillars 14. Starting from the hopper 6, a transfer device 8 formed by a chain and steel cross-bar conveyor raises the material towards a dumping hopper 9. The dumping hopper 9 is situated close to the rear of the chassis 7 above a reception hopper 10 of a finisher 11.

The finisher 11 is formed, in a known manner, by the reception hopper 10 disposed in such a manner as to dump the material onto a transverse helical screw 12 forming, in the present embodiment, a component for spreading the material over the highway 1. A table 13 for applying the coated materials is placed immediately behind the spreading component or screw 12, and has the function of smoothing out the layer 2 of the coated materials according to a Predetermined thickness. To this effect, the application table 13 is suspended at the rear portion of the front chassis 7, according to a height adjustable by hydraulic jacks (not shown).

Finally, the front chassis 7 carries a device 15 for distributing binding product 3, which device is essentially formed by a bar 16 disposed immediately before the spreading component 12 in the direction of travel of the vehicle.

So as to prevent an unevenness of the road surface, in the case of a bumpy highway, the vehicle is also equipped with a longitudinal evening device (not shown) which acts as a function of information supplied by sensors for example.

According to the invention, the vehicle comprises a second chassis 17 connected to the rear of the front chassis 7 by means of an articulation 18 disposed at the end of an arm 19. In the present embodiment, the rear chassis 17 is mounted on three rollers or balls 20 independently of the rolling elements of the front chassis 7, which rolling elements are formed by caterpillars 14. In other words, the rear chassis 17 forms a trailer for the front chassis 7.

Advantageously, the rear chassis 17 carries the motorization assembly 21 which is essentially formed by a thermal motor known per se, and which provides, by means of hydraulic control and transmission means 22, 22A also supported by the rear chassis, the travel of the vehicle by entrainment of the caterpillar 14 according to a pre-adjusted working speed, from a driving unit 24.

The motorization assembly 21 is connected to the rolling elements or driven caterpillars 14 of the front chassis 7 by means of a cardan or hydrostatic transmission 23, in a manner known per se and which will not be described here. The chassis 17 also carries a tank 25 for binding product 3 or asphalt emulsion, which tank comprises heating means (not shown). The tank 25 feeds the aforementioned spreading bar 16 by means of pipes 26. Several bar 16 may be disposed on the vehicle and act simultaneously according to angles and lengths which are variable as a function of the highway to be treated.

In this manner a significant weight is applied on the rear chassis 17, and therefore applied to the rollers or balls in order to form advantageously a compactor according to the invention.

This weight is nevertheless variable as a function of the contents of the tank 25. In order to remedy this there is provision for adding to the chassis 17 a deadweight 40, either rolling or not.

Thus, the first roller **20*a* of the compactor thus constructed is situated, in the direction of travel of the vehicle, immediately after the finisher 11**. It should also be noted that all the constituent elements of the vehicle have an absolutely identical, constant and regular speed of advance, and form a single road train behind which the passage of any other type of machine is not necessary.

According to alternative forms of the present embodiment, the helical screw 12 forming the component for spreading the coated materials 2, is laterally telescopic in such a manner that it can be adapted to the width of the highway. Its length is therefore variable between a width L equal to the width of the vehicle and a maximum extension width $L_1$. The length L is variable, for example, between 2.50 m and 4.50 m.

The application table 13 of the finisher 11 is likewise laterally telescopic for identical reasons to those mentioned hereinabove, but preferably the extension length $L_2$ chosen will be slightly greater than the spreading length $L_1$ so as not to leave a trace behind its passage.

Likewise, each roller **20*a* and 20*b* is designed in order to be laterally displaceable, on either side of the chassis 17 towards opposite positions A and B on either side of the axis of the vehicle, the third roller 20*c* and the deadweight 40** remaining fixed in transverse translational movement to the axis of the vehicle and completing the travel of the latter. Thus, a correct balancing of the assembly is obtained.

Figure 3:
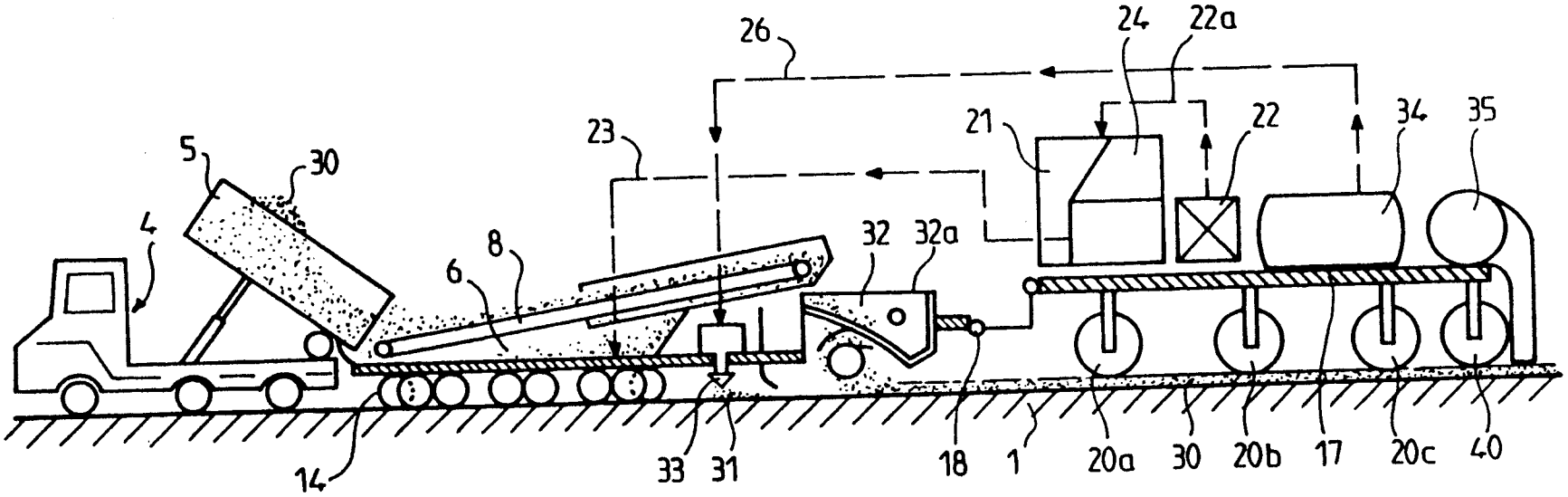
FIG. 3 is a longitudinal diagrammatic view of a vehicle according to an alternative embodiment of the invention.

The embodiment shown in FIG. 3 is particularly adapted to the repairs of highways by spreading chippings 30 after the spreading of a layer of binder 31.

Essentially it differs from the previous one in that the component for spreading chippings is formed by at least one hopper 32 equipped with gritters and loaded at its upper portion by its larger opening **32*a*, with chippings 30 fed by means of the transfer device 8, its narrower lower opening being situated close to the highway 1**.

As before, the spreading component formed here by the gritter hopper 32 is immediately preceded by a distribution bar 33 fed from a tank 34 for binder 31.

Of course the number of hoppers 32 and bars 33 may be increased, for example, to two.

In fact, in the present case, the hopper 32 replaces the finisher 11 which is specific to the application of coated materials.

Another difference in relation to the previous embodiment resides in the fact that the rollers or balls **20*a*, 20*b*, 20*c***, are replaced by wheels with pneumatic tires or by rubberized rollers. This makes it possible to prevent the crushing of the chippings which would certainly happen with three cylindrical rollers made of steel for example, taking into account the weight of the compactor assembly.

The compactor assembly constructed from the rear chassis 17 is equipped, at its rear portion, with a device 35 for sweeping and sucking up the excess chippings 30 on the highway.

Of course other alternative embodiments of vehicles may be devised on the basis of the concept of the present invention; for example, the spreading over the highway may be that of a mixture of any aggregate with a binder, previously kneaded and deposited on the highway immediately before the passage of the compactor assembly constructed according to the invention.

What is claimed is:

1. A road vehicle for spreading of materials for repair of a highway, comprising:

a carrier chassis mounted on rolling elements having associated therewith;

a device for receiving material;

a device for transferring the material towards a component for spreading the material over the highway;

a component for spreading the material over the highway;

a tank for product for binding the material onto the highway;

a binding-product distribution bar positioned in front of the spreading component;

a motorization assembly;

a unit for driving the vehicle;

a front portion of said chassis being mounted on rolling elements;

hydraulic control and transmission means connecting said motorization assembly to said rolling elements and to said unit for driving the vehicle; and a rear portion of said chassis being positioned in back of said component for spreading the material, said rear portion of said chassis being mounted on rollers or balls that are rotatable independently of said rolling elements connected to said motorization assembly and mounted on said front portion of the chassis, and said rear portion of said chassis having positioned thereon at least one of said motorization assembly, said tank, and said hydraulic control and transmission means, whereby weight of said at least one of said motorization assembly, said tank and said hydraulic control and transmission means is exerted on said rear portion of said chassis to form a compactor of materials spread over the highway.

2. The road vehicle according to claim 1, wherein said rear portion of said chassis and said front portion of said chassis are distinct, and are composed of a first chassis and a second chassis that are connected to each other by articulated linking means.

3. The road vehicle according to claim 1, wherein said rear portion supports said motorization assembly, and a cardan transmission connects said motorization assembly to said rolling elements of said front portion.

4. The road vehicle according to claim 2, wherein said second chassis portion supports said motorization assembly, and a cardan transmission connects said motorization assembly to said rolling elements of said first chassis.

5. The road vehicle according to claim 1, wherein said rear portion supports said motorization assembly, and a hydraulic transmission connects said motorization assembly to said rolling elements of said front portion.

6. The road vehicle according to claim 3, wherein said motorization assembly comprises a thermal motor, said hydraulic control and transmission means are supported on said rear portion, and said thermal motor in association with said hydraulic control and transmission means enable travel of the vehicle according to a pre-adjusted working speed.

7. The road vehicle according to claim 1, wherein said device for receiving the material is positioned on said front portion.

8. The road vehicle according to claim 1, wherein said component for spreading the material over the highway is positioned on a rear section of said front portion immediately in front of a first roller or ball of said rear portion.

9. The road vehicle according to claim 1, wherein said device for transferring connects the device for receiving the material to the component for spreading the material.

10. The road vehicle according to claim 8, wherein the binding-product distribution bar is positioned immediately before said component for spreading the material over the highway.

11. The road vehicle according to claim 1, of the finisher type, wherein said component for spreading comprises a helical screw onto which asphalt coated materials are brought by said device for transferring the material.

12. The road vehicle according to claim 11, wherein, in the direction of travel, said helical screw for spreading the asphalt coated materials is immediately preceded by said distribution bar fed with asphalt emulsion from the tank.

13. The road vehicle according to claim 11, wherein a table for applying the asphalt coated materials is positioned on said front portion, between said helical screw and a first roller of said rear portion.

14. The road vehicle according to claim 13, wherein said table is suspended at a rear section of said front portion, and further including hydraulic jacks to permit height adjustment of said table.

15. The road vehicle according to claim 13, wherein said table is telescopic to be adjustable to the width of the highway.

16. The road vehicle according to claim 11, wherein said helical screw is telescopic to be adjustable to the width of the highway.

17. The road vehicle according to claim 11, wherein said rear portion comprises at least three rollers, of which two rollers are telescopic in order to be adjustable to the width of the highway, and at least one other roller is transversely associated with said rear portion in a fixed, translational position.

18. The road vehicle according to claim 1, of the gritter type, wherein said component for spreading material comprises at least one hopper adapted to contain gritters, said hopper comprising a larger opening at its upper portion for receiving chippings furnished by said device for transferring, and a narrower lower, portion positioned close to the highway.

19. The road vehicle according to claim 18, wherein, in the direction of travel, said hopper is immediately preceded by said distribution bar capable of being fed with binder from said tank.

20. The road vehicle according to claim 18, wherein said compacting rollers of said second portion comprise wheels composed of pneumatic tires.

21. The road vehicle according to claim 18, wherein, at a rear section, said rear portion comprises a device for sweeping and sucking up excess chippings.

22. A road vehicle for spreading of materials for repair of a highway, comprising:

a carrier chassis having a front portion and a rear portion;

a motorization assembly;

said front portion being mounted on rolling elements rotatable by said motorization assembly, and said rear portion being mounted on rollers or balls that are rotatable independently of said rolling elements of said front portion;

a device for receiving material;

a device for transferring the material towards a component for spreading the material over the highway;

a component for spreading material over the highway;

a tank for product for binding the material onto the highway;

a binding-product distribution bar positioned in front of the spreading component;

a unit for driving the vehicle;

hydraulic control and transmission means connecting said motorization assembly to said rolling elements and to said unit for driving the vehicle; and said rear portion of said chassis having positioned thereon at least one of said motorization assembly, said tank, and said hydraulic control and transmission means, whereby weight of said at least one of said motorization assembly, said tank and said hydraulic control and transmission means is exerted on said rear portion of said chassis to form a compactor of materials spread over the highway.

* * * * *